US006811625B2

(12) United States Patent
Verma

(10) Patent No.: US 6,811,625 B2
(45) Date of Patent: Nov. 2, 2004

(54) METHOD FOR PROCESSING OF CONTINUOUSLY CAST ALUMINUM SHEET

(75) Inventor: Ravi Verma, Shelby Township, MI (US)

(73) Assignee: General Motors Corporation, Detroit, MI (US)

( * ) Notice: Subject to any disclaimer, the term of this patent is extended or adjusted under 35 U.S.C. 154(b) by 62 days.

(21) Appl. No.: 10/273,432

(22) Filed: Oct. 17, 2002

(65) Prior Publication Data

US 2004/0074627 A1 Apr. 22, 2004

(51) Int. Cl.[7] ..... C22F 1/047

(52) U.S. Cl. ..... 148/551; 148/552; 148/691; 148/692; 148/696

(58) Field of Search ..... 148/551, 552, 148/692, 691, 696

(56) References Cited

U.S. PATENT DOCUMENTS

| | | | |
|---|---|---|---|
| 4,531,977 | A | 7/1985 | Mishima et al. |
| 4,619,712 | A | 10/1986 | Miyamoto et al. |
| 6,253,588 | B1 | 7/2001 | Rashid et al. |
| 6,280,543 | B1 * | 8/2001 | Zonker et al. ..... 148/551 |

FOREIGN PATENT DOCUMENTS

| | | |
|---|---|---|
| EP | 91810410 A1 | 5/1991 |
| JP | 56036268 | 9/1982 |

OTHER PUBLICATIONS

"The Making, Shaping, and Treating of Steel" p1240.*

* cited by examiner

*Primary Examiner*—George Wyszomierski
*Assistant Examiner*—Janelle Morillo
(74) *Attorney, Agent, or Firm*—Kathryn A. Marra

(57) ABSTRACT

A method is disclosed for making relatively low cost sheet material of magnesium- and manganese-containing aluminum alloy for high elongation forming of articles of complex configuration. The alloy is continuously cast with an as-cast gage of 6–30 mm and immediately hot rolled with final strip exit temperature between 200 C. and 350 C., and net rolled gage reduction of 30–80% to 3–12 mm, and coiled. The hot rolled coil is annealed at 470–560° C. to homogenize the microstructure. After cooling to ambient, the coil is cold rolled to desired sheet thickness, but with a net gage reduction of 50–90%. After suitable recrystallization of the cold worked microstructure the sheet is ready for hot, high elongation forming.

10 Claims, No Drawings

METHOD FOR PROCESSING OF CONTINUOUSLY CAST ALUMINUM SHEET

TECHNICAL FIELD

This invention pertains to the thermomechanical processing of continuously cast aluminum alloy to form sheet stock suitable for high elongation, sheet metal forming operations. More specifically, this invention pertains to a specific sequence of hot rolling, coiling, annealing and cold rolling operations for a magnesium- and manganese-containing, continuously cast aluminum alloy to make such highly formable sheet material.

BACKGROUND OF THE INVENTION

Body panels for automotive vehicles are currently being manufactured using a superplastic (high elongation) forming process applied to certain magnesium-containing aluminum alloy sheet stock. At the present time, the sheet stock is a specially prepared, fine grain microstructure aluminum alloy 5083. AA5083 has a nominal composition, by weight, of about 4 to 5 percent magnesium, 0.4 to 1 percent manganese, a maximum of 0.25 percent chromium, up to about 0.1 percent copper, up to about 0.4 percent iron, up to about 0.4 percent silicon, and the balance substantially all aluminum. Generally, the alloy is chill cast into a large ingot about 700 millimeters in thickness and subjected to a long homogenizing heat treatment. The slab is then gradually reduced in thickness by a series of hot rolling operations to a strip in the range of four to eight millimeters, depending somewhat on the goal for the final thickness of the sheet, and coiled. The coiled strip is then heavily cold rolled, usually in stages with possible interposed anneals, to a final sheet thickness in the range of about one to three or four millimeters.

The result of the thermomechanical processing is a coil of smooth surface aluminum sheet stock, the microstructure of which has been severely strained. The sheet material is heated to recrystallize it to a strain relieved, fine grain microstructure (grains less than about ten micrometers) and to a suitable forming temperature, e.g., 450 C. to 500 C. In this condition a sheet blank can be stretch formed into an article of complex shape with regions of high biaxial stretching.

While this specially processed AA5083 type material is very useful for making articles such as automobile body panels it is much more expensive than the heavier carbon steel sheet which has long been used in the same applications. There is a need for a less expensive, aluminum alloy sheet material with the capability of being subjected to high elongation forming processes like superplastic forming, SPF, a relatively high temperature, low strain rate process. There is also a need for such aluminum sheet material in the more recently developed, quick plastic forming process, QPF, as disclosed in U.S. Pat. No. 6,253,588 to Rashid et al, entitled Quick Plastic Forming of Aluminum Alloy Sheet Metal. QPF is a high elongation sheet metal forming process similar to SPF. However, QPF usually involves somewhat lower forming temperatures, higher strain rates and different physical metallurgical forming processes than SPF. Other, forming processes involving substantial elongation of the aluminum alloy sheet material, e.g., warm stamping and warm hydroforming, would also benefit from the availability of relatively low cost, highly formable, aluminum alloy sheet material.

It is an object of this invention to provide a method for the lower cost production of highly deformable magnesium- and manganese-containing aluminum alloy sheet material. It is a more specific object of this invention to provide a thermomechanical process for converting continuously cast aluminum alloy into such relatively low cost, high elongation sheet stock.

SUMMARY OF THE INVENTION

The practice of this invention is particularly applicable to aluminum alloys consisting essentially of, by weight, 3.5 to 5.5% magnesium, 0.4 to 1.6% manganese, 0 to 0.5% chromium, and the balance substantially all aluminum. The alloy has typical levels of impurity materials such as iron and silicon. It is preferred that the alloys contain, by weight, 4.5 to 5% magnesium and 0.5 to 1% manganese.

A molten alloy of such composition is cast in a continuous caster to an as-cast gage of about 6 to 30 millimeters. There are a variety of suitable commercially available continuous casters for aluminum alloys. They include twin belt casters, twin roll casters and block type casters. The fast cooling rates inherent in continuous casting ensure that most of the solute elements, such as manganese, chromium and others, remain in supersaturated solid solution. The hot cast slab is immediately passed through a one to three stand tandem hot rolling mill to reduce its thickness and break up the as-cast dendritic microstructure. The rolling temperatures and the reduction levels in the hot rolling mill are managed such that the final hot rolled strip exit temperature is between 200 C. and 350 C., preferably between 230 C. and 330 C. This temperature range assures retention of some work strain in the metal. The net gage reduction from the cast slab to the rolled strip is in the range of 30 to 80% and the thickness of the hot rolled strip is between three and ten millimeters or so, the maximum thickness that can be effectively coiled. Preferably, the strip is coiled as it emerges from the last rolling stand.

The coiled hot rolled strip is annealed at 470 C. to 560 C. for three to twenty five hours. Typically, the annealing step can be carried out at 500 C. to 550 C. for five to fifteen hours to homogenize the microstructure of the cast and hot rolled strip and promote precipitation from aluminum solid solution of solute elements manganese, chromium and trace elements in the form of small, dispersed intermetallic particles. These particles serve a useful function in the final processing of the sheet material. The homogenization is, of course, completed more quickly at the higher temperatures. Following annealing the coil is cooled to ambient temperature for cold rolling.

The coil is subjected to one or more passes through a cold rolling stand to effect a cold reduction of the thickness of the strip by at least fifty percent and preferably fifty to ninety percent. Suitably, the cold rolled material is not annealed between rolling stages if more than one stage is used. The product of cold rolling is a severely worked cold rolled sheet of desired thickness for a high elongation sheet metal forming process. The sheet will typically have a thickness of about 1 to 3 mm for hot stretch forming into an automobile body panel or the like. The surface of the cold rolled material is usually smooth and defect free for commercially acceptable visual appearance in formed articles. The sheet is usually coiled as it leaves the cold rolling mill.

The cold rolled sheet is hard and unsuitable, as is, for high elongation forming such as SPF or QPF. The material must be heated to recrystallize the heavily worked microstructure to a soft very fine grained microstructure. The highly strained microstructure provides a favorable thermodynamic driving force for recrystallization especially when the material is heated to a suitable annealing temperature. The intermetallic particles formed during anneal of the hot rolled coil provide nucleation sites for new grains during a recrystallization anneal step. Suitable recrystallization occurs within a few minutes when the cold worked coil is heated at 325 C. to 525 C. The recrystallization step may be conducted on the full coil or on sheet metal blanks removed from the coil for heating to a suitable forming temperature prior to a SPF or QPF operation. The recrystallized product has a microstructure of grain size of about five to ten micrometers. The grains are mainly a solid solution of magnesium in aluminum with smaller dispersed intermetallic particles as described above.

The sheet product of this process has forming properties comparable to the sheet product produced from the conventional direct chill (DC) batch cast alloy of like composition and it is less expensive to produce. It has utility in forming processes in which portions of the sheet metal are expected to experience regions of relatively large biaxial stretching. Other objects and advantages of the invention will be apparent from a description of a preferred embodiment which follows.

DESCRIPTION OF A PREFERRED EMBODIMENT

A melt of, for example, a nominal composition, by weight, of 4.7% magnesium, 0.8% manganese, 0.25% chromium, typical impurity amounts of iron and silicon and the balance aluminum is prepared. This melt is used at a temperature of about 700 C. in a twin belt type continuous casting machine to produce a long, 20 mm thick slab of the alloy.

The hot cast slab is immediately hot rolled through a three stand tandem hot rolling mill to reduce the thickness of the continuously cast slab and to transform the dendritic as-cast grains to more equi-axed grains. The hot rolled strip exits the last roller at a temperature of about 300 C. and a thickness of 7 mm. The hot rolled strip experiences a reduction in thickness of about 65% with respect to the thickness of the cast slab. Of course, the strip grows in length and also slightly in width. The continuously produced hot strip is coiled as it exits the rolling mill. The coil is transferred to an annealing furnace and homogenized at 560 C. for 5 hours. The annealed coil is allowed to cool to ambient temperature.

When cold rolling equipment is available, the hot rolled coil is unwound and cold rolled in, e.g., three passes to obtain an 80% reduction in thickness to a gauge of about 1.5 mm sheet material.

The sheet material was annealed at 500 C. for 10 minutes to recrystallize the severely worked cold rolled microstructure. A tensile specimen was then cut from the annealed 1.5 mm thick sheet material and tested under superplastic forming conditions for this alloy. In other words, the tensile specimen was heated to a temperature of 500 C. and subjected to a tensile strain rate of $10^{-3}$ $s^{-1}$ which gave an average elongation of 350% plus or minus 10%. This elongation value is comparable with a similar sheet composition produced by the conventional direct chill batch cast method in which a relatively thick (about 700 mm) ingot is cast and annealed and extensively hot worked and then cold rolled to produce a relatively expensive sheet material.

The subject invention practice of controlled hot rolling temperature, coiling, annealing and subsequent cold rolling has a synergistic effect on sheet work hardening. This combination produces a harder sheet material than other processing sequences. The increased sheet hardness has an increased thermodynamic potential to increase grain refinement on recrystallization. Thus, a finer grain size sheet is produced after the cold worked material is heated to recrystallization. It has been found that the subject finer grain size aluminum alloy sheet has better mechanical properties and better formability for high elongation forming operations such as superplastic forming and quick plastic forming and the like.

The fast cooling rates obtained in continuous casting insure that most of the original solute alloyants such as manganese and chromium and others remain in a supersaturated solid solution state. The annealing treatment of the coiled hot rolled material precipitates solute elements such as manganese and chromium and others in the form of intermetallic particles. Preferably, these particles are quite small, e.g., one to five micrometers in largest dimension. These particles have a small size and distribution so that they act as sites for nucleating new grains during the recrystallization step.

In accordance with the utilization of subject invention, it is necessary that the cold rolled sheet material, which has been severely worked, be recyrstallized in order to place it in a fine grained metallurgical microstructure for high elongation forming. This heat treatment for recrystallization can be conducted at, e.g., 325 C. to 525 C. on a coil of the cold rolled material before its delivery to the manufacturing operation, which is intended to utilize the high elongation sheet material. In another embodiment, the cold rolled material can be shipped to a user and blanks cut from the coil. These blanks have to be heated to a forming temperature in which their high elongation is used, e.g., 470 C. This heating step will typically accomplish the desired recrystallization as the sheet material is heated to its suitable forming temperature.

While the invention has been described in terms of a specific embodiment, the scope of the invention is not limited by this illustrative example.

What is claimed is:

1. A method of making sheet material of magnesium- and manganese-containing aluminum alloy for sheet metal forming, said method comprising:

continuously casting a composition consisting essentially, by weight, of 3.5 to 5.5% magnesium, 0.4 to 1.6% manganese, 0 to 0.5% chromium and aluminum to form cast slab with an as-cast gage of about six to thirty millimeters;

hot rolling said cast slab through at least one hot roller stand to form a hot rolled strip that emerges from said rolling at a temperature in the range of 200 C. to 350 C. and having experienced a thickness reduction from the cast slab of 30–80% with a rolled strip thickness of about three to ten millimeters;

immediately coiling said hot rolled strip;

annealing the coiled strip at 470–560 C. for three to twenty five hours to produce a microstructure with dispersed intermetallic particles;

cold rolling said annealed strip through at least one cold rolling stage, without intermediate anneal, to effect a reduction of at least 50% in the thickness of the hot rolled strip and to yield said sheet material; and thereafter heating said cold rolled sheet material to recrystallize it to a microstructure characterized by grains no larger than about ten micrometers.

2. A method as recited in claim 1 in which said composition contains 4.5 to 5% magnesium.

3. A method as recited in claim 1 in which said composition contains 0.5 to 1% manganese.

4. A method as recited in claim 1 in which said hot rolled strip emerges from said rolling at a temperature in the range of 230–330C.

5. A method as recited in claim 1 comprising annealing said coiled strip at 500–550 C. for five to fifteen hours.

6. A method as recited in claim 1 comprising cold rolling said annealed strip to effect a reduction of 50–90% in the thickness of said hot rolled strip and to form a said sheet material less than four millimeters in thickness.

7. A method as recited in claim 1 where said recrystallized sheet material has an elongation of at least 300% in tensile test at 500 C. and a strain rate of $10^{-3}$ $S^{-1}$.

8. A method of making sheet material of magnesium- and manganese-containing aluminum alloy for sheet metal forming, said method comprising:

continuously casting a composition consisting essentially, by weight, of 3.5 to 5.5% magnesium, 0.4 to 1.6% manganese, 0 to 0.5% chromium and aluminum to form cast slab with an as-cast gage of about six to thirty millimeters;

hot rolling said cast slab through at least one hot roller stand to form a hot rolled and hot worked strip that emerges from said rolling at a temperature in the range of 230 C. to 330 C. and having experienced a thickness reduction from the cast slab of 30–80% with a rolled strip thickness of about three to ten millimeters;

immediately coiling said hot rolled strip;

annealing the coiled strip at 500–550 C. for five to fifteen hours to produce a microstructure with dispersed intermetallic particles;

cold rolling said annealed strip through at least one cold rolling stage, without intermediate anneal, to effect a reduction of at least 50% in the thickness of the hot rolled strip and to yield said sheet material; and thereafter heating said cold rolled sheet material to recrystallize it to a microstructure characterized by grains no larger than about ten micrometers.

9. A method as recited in claim 8 where said recrystallized sheet material has an elongation of at least 300% in tensile test at 500 C. and a strain rate of $10^{-3}$ $S^{-1}$.

10. A method of stretch forming a magnesium- and manganese-containing aluminum alloy sheet at a stretch forming temperature into a sheet metal article having a portion in which said sheet has undergone biaxial stretching, said method comprising using a sheet made by the method of claim 8.

* * * * *